United States Patent [19]

Perkins et al.

[11] Patent Number: 4,886,114

[45] Date of Patent: Dec. 12, 1989

[54] ELECTRIC SURFACE CONTROLLED SUBSURFACE VALVE SYSTEM

[75] Inventors: Donald H. Perkins, Carrollton; Thomas M. Deaton; Phillip S. Sizer, both of Farmers Branch, all of Tex.

[73] Assignee: Otis Engineering Corporation, Dallas, Tex.

[21] Appl. No.: 169,814

[22] Filed: Mar. 18, 1988

[51] Int. Cl.[4] ..... E21B 43/12

[52] U.S. Cl. ..... 166/65.1; 166/66.4; 166/332; 251/129.04

[58] Field of Search ..... 166/246, 65.1, 66.4, 166/66.5, 332; 439/193; 251/129.04, 129.09, 129.15, 129.18; 137/418, 531

[56] References Cited

U.S. PATENT DOCUMENTS

| | | | |
|---|---|---|---|
| 3,507,330 | 4/1970 | Gill | 166/248 |
| 3,642,066 | 2/1972 | Gill | 166/248 |
| 3,865,142 | 2/1975 | Begun et al. | 137/635 |
| 4,002,202 | 1/1977 | Huebsch et al. | 166/65.1 |
| 4,161,215 | 7/1979 | Bourne, Jr. et al. | 166/66.4 |
| 4,191,248 | 3/1980 | Huebsch et al. | 166/66.4 |
| 4,321,946 | 3/1982 | Paulos et al. | 137/554 |
| 4,566,534 | 1/1986 | Going, III | 166/65.1 |
| 4,716,960 | 1/1988 | Eastlund et al. | 166/60 |

*Primary Examiner*—William P. Neuder
*Attorney, Agent, or Firm*—Johnson & Gibbs

[57] ABSTRACT

A solenoid operated valve system for petroleum production wells including a solenoid operated valve securable in a well bore connected in electrically insulated relation with the lower end of a tubing string extending to the surface and a tubing string below the valve to a well packer and an electric circuit from a control system at the surface through the tubing string to the valve and back to the surface in the casing the tubing and casing serving as the electrical conductors for opening the valve and monitoring the valve position. The solenoid operated valve has an operator tube formed of tubular sections of different magnetic characteristics so that the valve is opened against a biasing spring by a high current flow and held open by a current flow of a lower value. The valve solenoid is operable by either AC or DC current.

44 Claims, 4 Drawing Sheets

ELECTRIC SURFACE CONTROLLED SUBSURFACE VALVE SYSTEM

BACKGROUND OF THE INVENTION

1. Field of the Invention

The invention relates to solenoid operated valves for petroleum production wells and, more particularly, to a power supply and control arrangement for an electrical solenoid operated safety valve system.

2. History of the Prior Art

Oil and gas wells, and in particular those located offshore, are frequently subject to wellhead damage which may be produced by violent storms, collisions with ships and numerous other disastrous occurrences. Damage to the wellhead may result in the leakage of hydrocarbons into the atmosphere producing the possibility of both the spillage of the petroleum products into the environment as well as an explosion and fire resulting therefrom. In addition to off-shore production wells, another environment in which damage to a wellhead may have disastrous effects is that of producing wells located in urban areas. Moreover, in such urban production wells, it is generally a specific legal requirement that there be some downhole means of terminating the flow of petroleum products from the well in the event of damage to the wellhead. In such instances, the safety valve system must be responsive to a dramatic increase in flow rate from the well so as to close down and terminate production flow from the well. For these reasons, sub-surface safety valves located downhole within a borehole have long been included as an integral part of the operating equipment of a petroleum production well.

Various types of petroleum production flow safety valve systems have been provided in the prior art. Each system includes a valve means for controlling the flow of petroleum products up the tubing from a point down in the borehole from the wellhead. Safety valve systems also include sensing means which are responsive to wellhead damage, a dramatic increase in production flow, or some other emergency condition requiring that the flow from the well be terminated by the valve.

One type of operating mechanism used to actuate a safety valve within a well includes an electrical solenoid employed to hold the safety valve in an open condition and a spring means to return it to a normally closed condition in response to interruption in the flow of current to the solenoid. Numerous such systems have been proposed, for example, U.S. Pat. No. 4,002,202 to Huebsch et al, U.S. Pat. No. 4,161,215 to Bourne, Jr. et al, and U.S. Pat. No. 4,566,534 to Going III. Each of these systems provide a solenoid actuated operating mechanism for the safety valve which is responsive to a DC electric current supplied from surface equipment. Such solenoids generally require a fairly high level surge of initial operating current to cause the solenoid to operate and change states and then a smaller level of current to hold the solenoid in its operated condition. These large actuating current surges require heavy electrical conductors in order to carry such current downhole for any substantial distance and still maintain a voltage level sufficient to operate the solenoid. Such heavy electrical conductors are both relatively expensive as well as difficult to install and maintain in a downhole production flow environment.

In subsurface safety valve systems, it is also highly desirable to be able to monitor the state of actuation of a solenoid operated safety valve in order to be able to provide a positive indication to an operator at the surface as to the open/closed state of that valve in order to monitor and control the output from the well as a function of the valve position. Prior art systems for monitoring the condition of a solenoid operated safety valve have included U.S. Pat. No. 4,321,946 to Paulos et al. The Paulos system includes monitoring the voltages on the winding of the solenoid as the solenoid changes state from one condition to another. Paulos' circuitry monitors the back EMF generated by the solenoid as it changes states to indicate the fact that the safety valve has in fact changed state in response to an actuation voltage applied to it. One drawback of such systems is that an indication of the safety valve condition of operation is only produced during the brief time period when the solenoid is changing states. There is no way in which system relying upon the generation of back-EMF can be continuously monitored during the valve open condition to ensure that the valve remains in the open condition.

In other prior art systems, the conductive pipe comprising the tubing and casing of a petroleum production well have been used to conduct a flow of electricity from the surface down into the borehole. For example, in U.S. Pat. Nos. 3,507,330 and 3,642,066 to Gill, a flow of AC current is passed down a conductive path including the tubing and casing of a well and through the connate water within the geological formation itself in order to heat the oil based production fluids within the formation to reduce their viscosity and effectuate their flow into the producing well. Similarly, in U.S. Pat. No. 3,958,636 to Perkins, a pair of wells which are spaced transversely from one another in a formation have electrodes inserted down into the boreholes of the wells. Electric current is caused to flow between the two electrodes in order to heat the geological formation between the wells to increase the flow of the petroleum products from the wells. In virtually all of such prior art systems, current sent down the conductive tubing portions of a well completion is used to heat or treat the formation rather than to control electrically operated devices down in the well.

The inherent disadvantages of providing heavy expensive electrical cabling downhole is obviated by the system of the present invention which provides means for coupling current from the surface down the electrically conductive path formed by the well tubing and casing and interconnecting that current to the windings of a solenoid actuated safety valve. The system allows actuation of the solenoid and control of the safety valve in response to signals and power generated at the well head. In addition, the system of the present invention also allows continuous monitoring of the open/closed condition of the solenoid operated safety valve by measuring parameters of the solenoid continuously so that any change in the condition of the valve is indicated immediately to a monitoring station at the well head.

The system of the present invention overcomes many of the inherent disadvantages of the prior art electrically operated solenoid actuated safety valve systems as well as enables continuous monitoring of the state of such safety valves.

SUMMARY OF THE INVENTION

The system of the present invention includes supplying power and monitoring signals to an electrically operated solenoid actuated safety valve in a petroleum production well completion within the borehole by means of the conductive well tubing and casing. A surface control unit supplies electrical power which is coupled to the tubing and casing. The downhole tubing string is electrically insulated from the wellhead equipment as well as the casing which extends from the surface to a point at which power is coupled into one side of the electrical solenoid actuating the valve. The other side of the solenoid is electrically connected to the casing to form a current return path to the surface. A monitoring signal is also coupled to the electrical casing and tubing and, thus, into the windings of the solenoid so as to provide an indication of the inductance of the solenoid coil and monitor any change in the inductance produced as a result of movement of the armature within the coil of the solenoid indicating a change in the condition of the safety valve.

In one aspect of the invention an electrically operated solenoid actuated safety valve system for use in a borehole uses a well casing formed of electrically conductive material extending down the walls of the borehole. A production tubing extends co-axially down the casing for the flow of borehole fluids from within the well to the wellhead, with the tubing being formed of electrically conductive material and mechanically supported at the wellhead but being electrically insulated from the casing. A tubular safety valve housing assembly is attached to the lower end of the tubing by means of a mounting assembly mechanically connected to the lower end of the tubing but being electrically insulated therefrom. The housing includes means for mounting within it a solenoid coil and a moveable magnetic armature, being affixed to actuate a safety valve in response to the flow of current through the solenoid coil. The safety valve is normally closed by a spring bias in response to deenergization of the coil and the body of the housing is electrically connected to the casing of the well bore to complete an electrical circuit therewith. A DC electric current potential is applied between the casing and the tubing at the well head to cause current flow through the coil of the solenoid within the housing and effect opening of the safety valve.

In other aspects, the electrically operated solenoid actuated safety valve of the invention includes a tubing flange connected to the wellhead for supporting the tubing extending down the borehole but electrically insulating the tubing from the support structure at the wellhead and along with means for mechanically connecting but electrically isolating the housing of the safety valve from the lower end of the tubing. One embodiment of this aspect also includes means for isolating the housing from the tubing with an upper insulating o-ring adaptor having a cylindrical portion extending between the side walls of the tubing support adaptor and the inner end of the housing. The upper adaptor includes a radial extending flared region having a plurality of circumferential groves for the receipt of o-rings fitted therein to mechanically seal the interior of the housing against the migration of borehole fluids.

Another aspect of the invention includes a system for the monitoring of the operated condition of an electrical solenoid operated safety valve system. A solenoid is located downhole for actuating a safety valve along with a means for electrically connecting the solenoid to the well head. Means for monitoring the current flow through the electrical connections between the wellhead and the solenoid coil includes an inductance monitoring circuit for continuously measuring the inductance value continuously of the solenoid coil at the wellhead. A position logic circuit is connected to the inductance monitoring circuit for monitoring the position of the solenoid in response to the inductance value thereof. A decision logic circuit is connected to the output of the solenoid position logic circuit for actuating a switching circuit for applying a high value of current to the solenoid to effect a switching of the solenoid operate valve from a closed position to an open position and, in response to the detection of a change in the position of the solenoid, to discontinue the high value of current. Another circuit applies a low value of current to the solenoid to hold the solenoid in an actuated condition following initial actuation thereof and interrupts flow of the low value of current to the solenoid to effect closure of the valve in response to a desired closed condition.

BRIEF DESCRIPTION OF THE DRAWING

For an understanding of the present invention and for further objects and advantages thereof, reference can now be had to the following description taken in conjunction with the accompanying drawing in which.

DESCRIPTION OF THE PREFERRED EMBODIMENT

Figure 1:
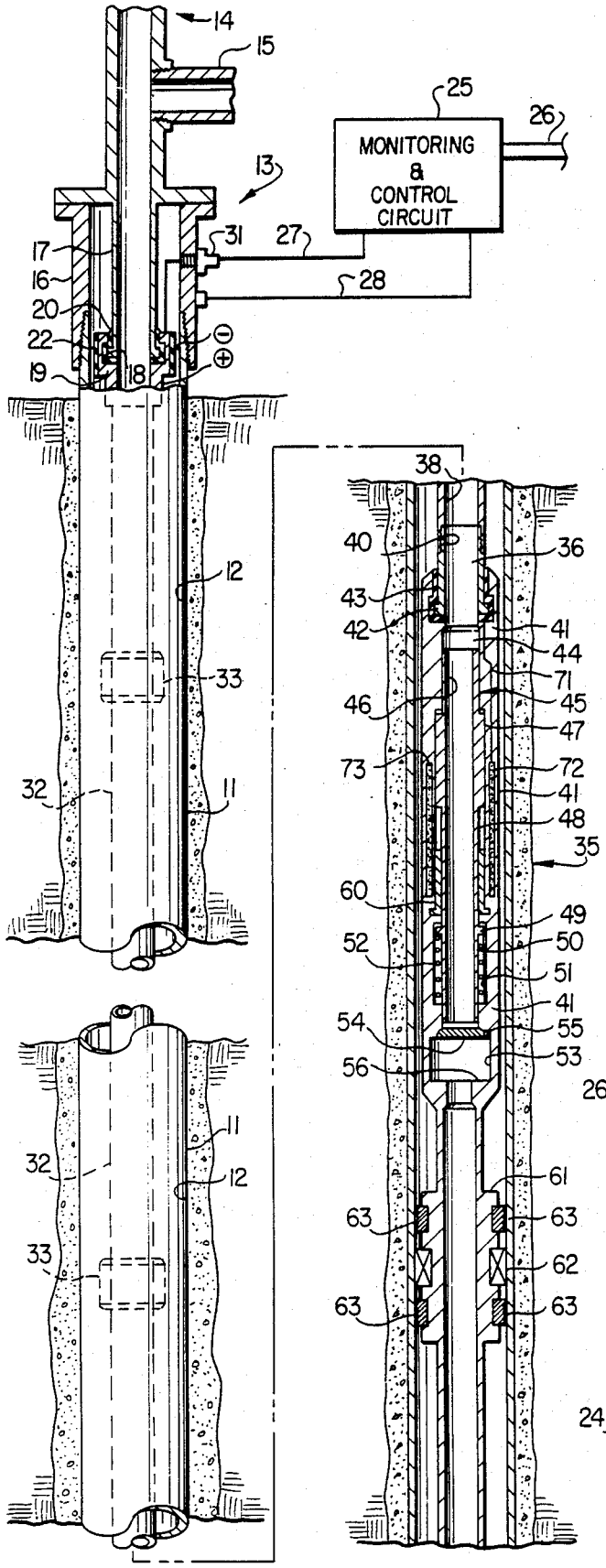
FIG. 1 is a schematic drawing of the well completion including an illustrative cross-sectional view of an electrically operated solenoid actuated safety valve system constructed in accordance with the teachings of the present invention.

Referring first to FIG. 1, there is shown a schematic cross-sectional illustration of a well completion incorporating the electrically operated solenoid actuated safety valve system of the present invention. A casing 11 is positioned along the borehole 12 formed in the earth and extending from a wellhead 13 located at the surface down into the petroleum producing geological formation. The wellhead 13 includes a typical Christmas tree production flow control configuration 14 having an output line 15 leading to storage facilities (not shown) for receiving production flow from the well. A wellhead support flange 16 is formed of conventional conductive metal material and is mechanically and electrically connected to the casing 11 extending down the borehole 12. A tubular production conduit 17 extends from the output line 15 co-axially through the wellhead support flange 16 and includes an outwardly flared radially extending flange region 18 at its lower end. The flange region 18 of the production conduit 17 extends into and is physically coupled with the open end of a tubing head 19 but is electrically insulated therefrom by an electrically insulative shield 20 which surrounds the radialy flared flange 18 to mechanically connect it to the tubing head 19 but electrically insulate it. The cylindrical outer periphery of the tubing head 19 is also covered with electrically insulative material 22 so that in the event there is mechanical contact between the outer walls of the insulator 22 and the inner walls of the casing 11 no electrical conduction will take place.

A wellhead monitoring and control circuit 25 is connected to a source of AC electric current by means of a cable 26 and includes means for rectifying current from that source and producing a positive DC voltage on a first power cable 27 and a negative DC voltage on a second power cable 28. The negative potential on the second cable 28 is electrically connected to the wellhead support flange 16 which is, of course, electrically connected to the casing 11 and the earth potential of the borehole. The positive potential on the first cable 27 passes through an insulator 31 extending through the sidewalls of the wellhead support flange 16 and is electrically connected to the upper end of the tubing head 19 which is electrically insulated from both the wellhead support flange 16, by means of the insulator 22, and from the tubular production conduit 17 by means of the insulator 20.

The tubing head 19 is mechanically and electrically connected in conventional fashion to additional elongate sections of tubing 32 which extend coaxially down the casing 11. Insulative tubing centralizers 33 are longitudinal spaced from one another along the tubing 32 to support the tubing near the central axis of the casing 11 and to prevent any electrically conductive contact therewith.

At the lower end of the tubing 32 there is positioned a solenoid safety valve assembly 35 which is coupled to the lower end of the tubing by means of an assembly support flange 36 which threadedly engages the lower end of the tubing 32. The safety valve assembly includes an elongate housing 41 formed of a conventional electrically conductive magnetic material having a generally cylindrical outer configuration and recesses formed therein for receiving the components of the solenoid operated safety valve. The assembly support flange 36 includes a threaded tubular upper end 40 and a lower end having a radially extending flange portion 42 which is mechanically attached to but electrically insulated from the inner walls of the housing 41 by means of an electrically insulative upper adaptor 43. The adaptor 43 electrically isolates the positive electrical potential on the tubing 32 from the negative potential of the housing 41. The housing 41 includes an axially extending central bore 44 for receiving an operator tube 45 adapted for axial movement therein. The operator Tube 45 may preferably be formed of several cylindrical sections of different thickness and mass as well as of materials having different magnetic permeability. At the upper end of the operator tube 45 there is a relatively thin walled upper section 46 formed of relatively less magnetic material, such as 9CR-1MOLY steel. An intermediate armature portion 47 is constructed of a highly magnetic material such as 1018 low carbon alloy steel and forms a central portion of the operator tube 45 while an elongate thin walled lower section 48 is formed of the less magnetic material such as 9CR-1MOLY steel. The bottom section 50 located at the lower end of the operator tube 45 is also of relatively less magnetic material and includes a radially extending circumferential flange member 49 which is received within a radially extending cavity 51 formed in the inner walls of the housing 41. A helical spring 52 surrounds the lower end 48 of the operator tube 45 and normally biases the tube in the upward direction by a force exerted against the circumferential flange 49.

A lower cavity 53 in the housing 41 receives a valve flapper member 54 which is pivotally mounted to the sidewall of the housing 41 by a hinge 55 which is spring biased toward the closed position, as shown. A sufficient force against the upper side of the valve flapper 54 will cause it to pivot about the hinge 55 and move into the side walls of the cavity 53 thereby opening the interior axial passageway 44 through the housing 41 to allow the flow of borehole fluids lower down in the borehole up the tubing to the wellhead. The lower end of housing 41 is mechanically and electrically connected to well packer 61 by an additional portion of production conduit 17 therebetween. Packer 61 include radially extending seal elements 62 which form a fluid barrier with the inside wall of casing 11. Packer 61 directs the flow of well fluids between wellhead 13 and a downhole formation (not shown) via production conduit 17 and safety valve 35. Slips 63 carried by packer 61 form a series of toothed engagements with the inside wall of casing 11 to anchor packer 61 at a selected downhole location. Slips 63 mechanically and electrically engage packer 61 with casing 11 to form a positive electrical contact between casing 11 and housing 41 of safety valve assembly 35. If desired, one or more conventional tubing centralizers (not shown) with bow springs or other contacting means could be installed in the portion of production conduit 17 between safety valve 35 and well packer 61. The bow springs on such centralizers can provide additional electrical contact with casing 11.

The assembly support flange 36 is electrically connected to a conductive cable 71 which extends through an opening in the insulative upper adaptor 43 down through a passageway formed in the side wall of the casing 41 to electrically connect with one end of an electrical solenoid 72 in a cavity formed in the inner side walls of the housing 41. The solenoid coil 72 comprises a plurality of helically wound turns of a conductor. The other end of the winding of the solenoid coil 72 is electrically connected to the body of the housing 41 by means of a set screw 73 to thereby indirectly form an electrical connection with the casing 11.

The coil 72 is positioned within the body of the housing 41 so that the highly magnetic armature portion 47 of the operator tube 45 is located near the upper ends of the coil 72 when there is no current flow through the coil and the tube 45 is in its upwardly spring biased position. A cylindrical magnetic stop 60 is positioned within the central bore 44 near the lower end of the solenoid coil 72 so that the lower portion 48 of the operator tube 45 is axially movable there through. A mechanical stop 56 is formed on the lower inside edges of the cavity 53 to limit the extent of the downward movement by the operator tube 45. When the lower edge of bottom section 50 of the operator tube 45 abuts the mechanical stop 56, the lower edge of the armature portion 47 is spaced by a small but distinct air gap from the upper edges of the magnetic stop 60. The highly magnetic stop 60 creates a low reluctance path for magnetic flux generated by the solenoid coil 72 so that the armature 47 of the operator tube can be held adjacent thereto by a relatively low value of current flow through the coil 72. The air gap, for example on the order of 0.0050 inch, is provided to insure that the operator tube 45 will return to its upper position in response to the force generated by the bias spring 52 when current is removed from the coil 72 and not be retained in its lower position by residual magnetism due to physical contact between the operator tube 45 and the magnetic stop 60.

When an actuation current of a first value flows through the winding of the solenoid coil 72 the magnetic flux generated thereby causes the armature 47 to move downwardly toward the center of the coil 72. As the lower edges of the operator tube 45 move downwardly toward the mechanical stop 56, they cause the spring biased flapper 54 to pivot about hinge 56 into the cavity 53 to open the safety valve and allow production fluids to flow up the tubing to the wellhead. When the operator tube moves to its lower actuated position the helical spring 52 is compressed by the circumferential flange 49. Once the armature 47 has been moved to the lower position by a relatively high value of magnetic flux produced by a relatively high value of actuation current through the solenoid coil 72, the lower edge of the armature is closely spaced from the magnetic stop 60. Thereafter, a relatively lower value of magnetic flux generated by a relatively lower value of holding current through the coil 72 will retain the operator tube 45 in its lower, actuated position and the valve flapper 54 in the open condition. Removal of all current from the coil 72 allows the spring 52 to move the operator tube 45 to its upper position which allows the spring biased hinge 52 to close the flapper 54 and, thus, the safety valve to the flow of any borehole fluids up the tubing 32 to the wellhead.

The power to actuate and hold open the safety valve comes from the monitor and control circuit 25 at the wellhead 13 by means of the conductive tubing and casing of the well completion. DC electric current from the cabel 27 is coupled through the conductive tubing head 19 down the length of tubing 32 into the valve assembly support flange 36. The flange 36 is connected to the electrical conductor 71, one end of the windings of the solenoid coil 72, through the coil 72 and out the other end to the connector 73 and the conductive body of the housing 41. The housing 41 is electrically connected through the conductive slip 61 to the conductive casing 11 and back to the negative cable conductor 28 which returns to the monitoring and control circuit 25. Thus, electrical current is coupled from the wellhead down the tubing and casing of the borehole production assembly and is used to operate the solenoid of the safety valve assembly. The system of the invention contemplates a perodic reversing of the polarity of the DC current from the monitoring and control circuit 25 located at the wellhead, for example on a weekly or monthly basis. This would serve to minimize the effects of downhole galvanic corrosion within the system.

It can be seen from FIG. 1 that the application of electric current from the wellhead down the electrically conductive tubing and casing to the solenoid coil 72 will pull the armature 47 of the operating tube 45 in a downward direction against the bias of the spring 52 to press against the flapper door 54 and cause it to pivot about its spring biased 55 into the cavity 53 against the inner side wall of the housing. The operator tube 45 moves downwardly until the lower edges of the tube abut the mechanical stop at the upper edges 56 of the cavity 53. In addition, the lower edges of the armature portion 47 of the operator tube 45 closely approach but are physically separated from the upper edges of the magnetic stop 60. The magnetic stop 60 completes a low reluctance magnetic circuit from the solenoid coil through the armature 47 to allow the armature to be held in the lower position by means of a lower valve of magnetic flux, and hence a lower holding current through the solenoid than is necessary to cause the operator tube 45 to move downwardly in the first instance. The upper edges of the magnetic stop 60 are physically spaced from the lower edges of the armature 47 by means of an air gap.

As can be seen, the system of the present invention shown in FIG. 1 illustrates the manner in which the conductive tubing and casing of a relatively conventional well completion are used to deliver operating current to the solenoid operated safety valve within the valve assembly, thus, eliminating the necessity for heavy electrical cables extending down the well along with the tubing. In addition, the conductive pathway of the tubing and casing of the production completion also allow monitoring of the operated state of the valve as will be further explained in connection with the discussion of the figures below.

It should be noted that the preferred embodiment of the system is used with solenoid operated safety valves, the system of the present invention can also be used to provide operating power and control to other types of solenoid operated valves such as a solenoid operated gas lift valve as shown in U.S. Pat. No. 3,427,989. It should also be understood that although DC current and solenoids are preferred, AC solenoids could also be used in certain embodiment of the system of the invention.

In one embodiment of the system of the present invention, it is preferable to run relatively less electrically conductive borehole fluids into the annular space between the tubing and the solenoid operated safety valve assembly and the conductive wall of the casing to ensure as high a level of insulation as possible between the two electrical elements of opposite potential. That is, borehole fluids such as kerosene or oil based muds and other less electrically conductive types of annular fluids create a less conductive shorting element and, thus, a more conducive environment to the operation of the system of the present invention. One annulus fluid having low conductivity satisfactory for use is oil external emulsion completion fluid, such as HLX-W230 with calcium chloride as an internal aqueous phase. The fluid density was 11.6 lbs/gal. HLX-W230 is available from Halliburton Services, Drawer 1431, Duncan, OK 73536. Of course, the deeper the borehole location of the safety valve assembly, the more important is the low conductivity of the annular borehole fluid. In shallow wells even a relatively more conductive fluid may not have a significant shorting effect on current flow through the well tubing and casing.

Figure 2:
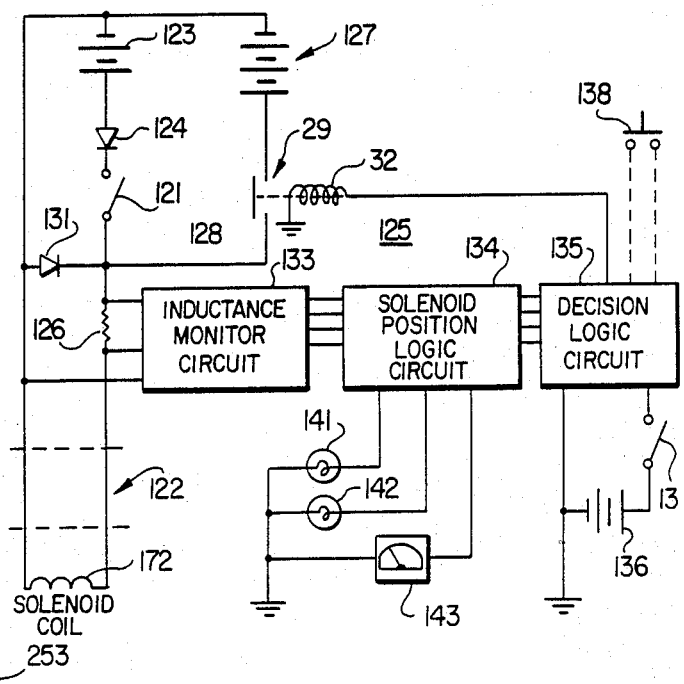
FIG. 2 is a schematic diagram of the electrical circuitry of one embodiment of the electrically operated solenoid actuated safety valve system of the present invention.
Figure 3B:
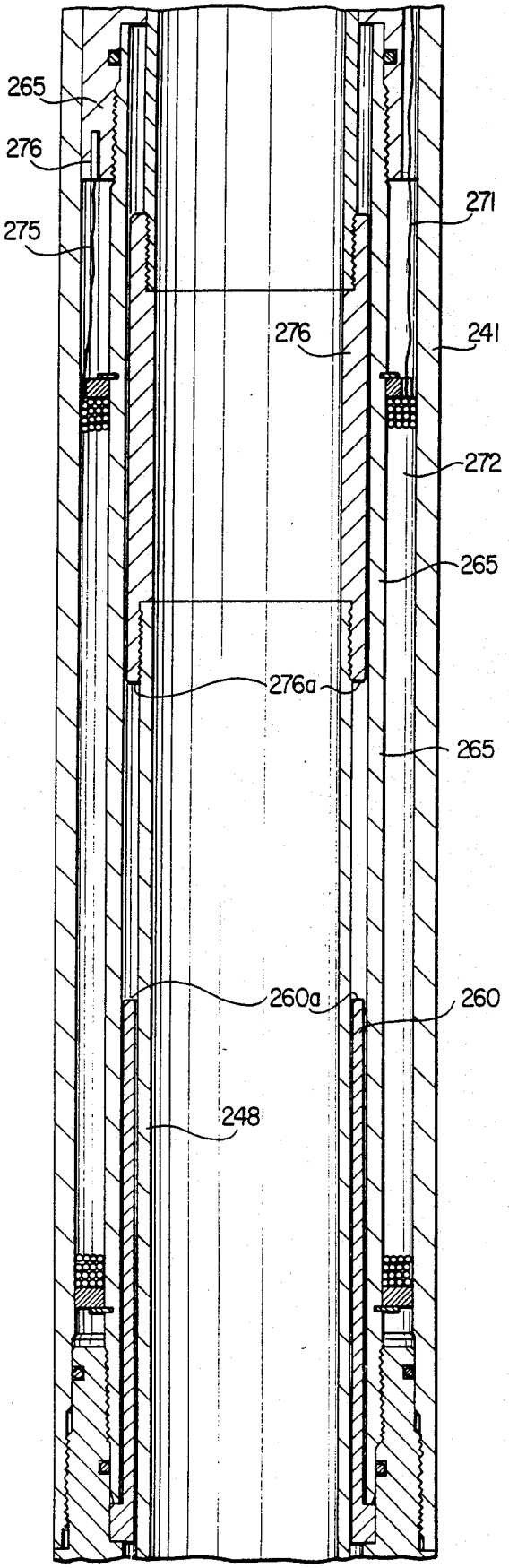
Figure 3C:
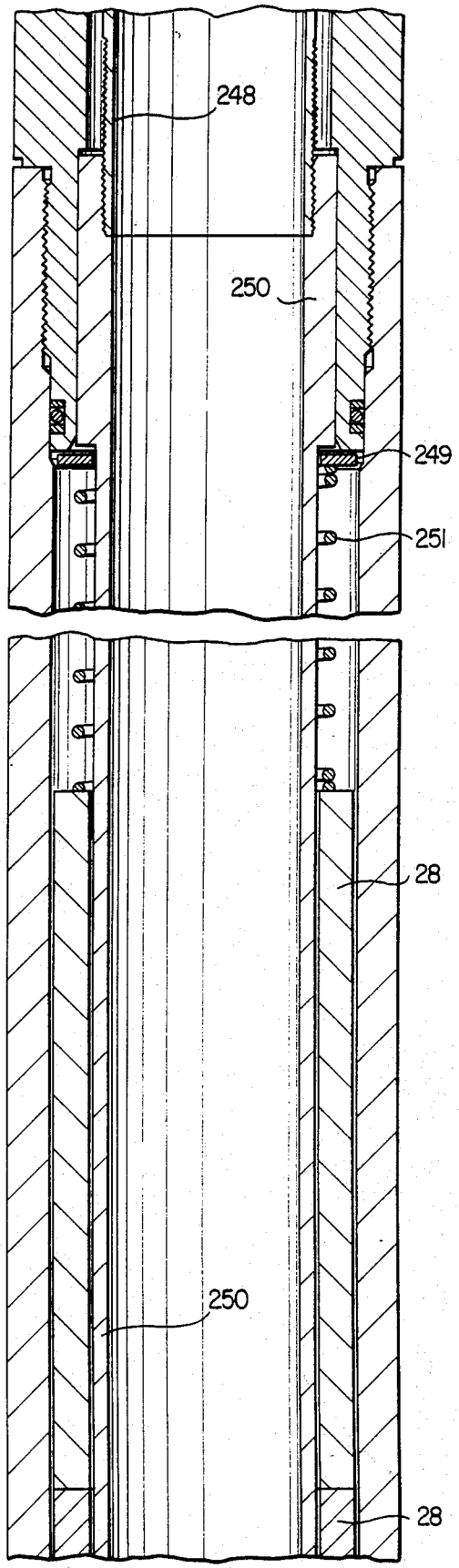

Referring next to FIG. 2, there is shown a schematic drawing of one embodiment of a circuit for operating and monitoring the condition of a solenoid actuated safety valve in accordance with the system of the present invention. The circuit has the capability of actuating the solenoid operated valve from a closed to an open position by the application of a relatively high value of DC current to change the state of the solenoid and then holding the valve in the open position by applying a relatively lower value to the solenoid. Removal of all electrical power to the solenoid controlling the valve allows a spring-biased closure member incorporated in the valve to close the valve as discussed above.

The position (open or closed) of the safety valve 35 is important to the well operator. When valve 35 is closed, armature 47 is spaced longitudinally away from solenoid coil 72. In this position, inductance should be relatively low. There is a large opening in the solenoid coil (low permeability). It should be noted that DC current is not affected by the inductance of solenoid coil 72, only resistance of the wires limits DC current.

When valve 35 is in its open position, armature 47 is radially adjacent to coil 72. At this same time inductance of the electrical circuit is high due to the physical presence of armature 47 within coil 72. High inductance with a constant AC voltage means a decrease in AC current flow. High inductance occurs when the valve is open.

The well operator is interested in one light to show that valve 35 open and one light for closed. Many physical characteristics could be sensed to turn the lights on and off. For example, voltage applied or current flow through coil 72. However, just the presence of voltage or current does not indicate the true position of armature 47 and a sensing of the change in current is required.

Magnetic fields do not like change and generate voltage to resist change. The previously noted change in reluctance generates back EMF as armature 47 moves to the valve open position. Current cannot change instantaneously therefore measurement of back EMF is some indication of armature movement. A preset timer can also be used to turn the lights on and off, however, time just like voltage and current is not a true indication of valve position.

The formula for inductance (L) demonstrates that the value of inductance is a function of the physical characteristics of coil 72. Movement of armature 47 changes at least one physical characteristic-permeability. Effective cross section area might be changed however, permeability is certainly the dominant factor. AC voltage and AC current flow are sensitive to changes in inductance. The required AC current flow could be relatively insignificant as compared to the DC opening current or the smaller DC hold open current. 60 Hertz and 400 Hertz AC voltage generators are commonly available. It will be appreciated that specific values of inductance are a function of the operating environment—well fluids, casing, tubing, earth formation, etc., and materials used to manufacture valve 35. Safety valves from identical materials will have variations in inductance due to variations in manufacturing tolerances (e.g. length and air gap). For a specific valve in a specific environment coil 72 will have a unique value of inductance for armature 47 in the valve open and valve closed positions. Equipment to measure inductance is commercially available from many companies, including Hewlett-Packard.

The position of armature 47 can also be sensed by limit switches which are tripped at the end of each stroke. Limit switches could compromise the fluid integrity of housing 41 and Reed switches are an alternative type of limit switch. A small solenoid(s) could also be placed in housing 41 to sense movement of armature 47. Measuring the inductance of coil 72 is as accurate indication of armature position as any of these alternatives and does not add any extra cost or complexity to valve 35.

The circuit of FIG. 2 also has the added capability of constantly monitoring the open/closed condition of the safety valve as a function of the solenoid armature position and varying the valve operations based upon its condition. Valve condition monitoring is accomplished by comparing the measured inductance of the coil of the solenoid with known open valve and closed valve inductance values. The inductance of the solenoid actuating the valve changes as a function of the position of the armature within the coil of the solenoid. Regular periodic or constant monitoring of the valve position allows highly useful operational features to be incorporated into the present system such as "valve open" and "valve closed" indications, valve position indications, and high and low power control features based upon valve position.

As shown in FIG. 2, the solenoid coil 172 used to actuate the safety valve is connected to the rest of the circuit 125 which is located at the surface by means of electrically conductive well tubing and casing, schematically represented at 122. The conductive path passes through a relatively low holding current power supply, illustrated by battery 123, a protection diode 124, a control switch 121, and a current monitoring resistor 126. A relatively higher value actuation current source, represented by battery 127, is connected in parallel through a normally open contact 128 of a contactor relay 129. The relay 129 includes an actuation coil 132 which closes the contacts 128 and connects the higher power source 127 to the conductive path 122 leading to the solenoid coil 172. Current flow through the monitoring resistor 126 is coupled to an inductance monitor circuit 133 the output of which is connected to a solenoid position logic circuit 134. The output of the logic circuit 134 is in turn connected to a decision logic circuit 135 which is powered by a voltage source 136 coupled to the circuit by means of a switch 137. The decision logic circuit 135 is also connected to a momentary contact switch 138. The solenoid position logic circuit 134 includes a valve open indication lamp 141, a valve closed indication lamp 142 and a current flow meter 143.

When switch 121 is closed, the lower power source 123 supplies a low voltage current through the diode 124 and the current measuring resistor 126 to the solenoid coil 172. Whenever switch 137 is closed power is supplied from source 136 to the monitor/logic circuits and measurement of the inductance of the solenoid coil 172 by means of inductance monitor circuit 133 begins. Depression of momentary contact switch 138 causes the decision logic circuit 135 to supply current to the coil 132 of relay 129 closing the contacts 128. This applies a relatively high voltage current from source 127 through resistor 126 to the solenoid coil 172 causing it to actuate and open the safety valve. When the armature of the solenoid coil 172 changes position to open the valve, the change in current flow through resistor 126 is detected by the inductance monitor circuit 133 which provides a signal to the solenoid position logic circuit 134. The open valve indication lamp 141 is then illuminated and the closed valve indication lamp 142 is extinguished. When the solenoid position logic circuit 134 detects that the valve has reached its open or predetermined position, it provides a signal to the decision logic circuit 135 which removes current from the coil 132 of the relay 139 to interrupt the flow of the relatively high current value from the source 127 to the solenoid coil 172. The decision logic circuit 135 limits the time period during which a high power value is applied to the solenoid coil 172 in case the valve does not open during this preselected time period. In addition, the decision logic circuit 135 also allows the reapplication of current to the relay 129 after a preselected time period in order to try and reopen the valve after a selected cool-down period in the event the solenoid fails to fully open or partially closes after the first attempt to open.

In FIG. 2, the diodes 124 and 131 protect the switches 121 and 128 from high values of back EMF during the valve opening process. The resistor 126 provides a voltage drop used in the monitoring of the inductance of the solenoid coil 172. The inductance monitor circuit 133 may also send a high frequency signal, for example around 60–120 Hz down the conductive path 122 to the coil 172 in order to monitor changes in the returned signal for purposes of determining the inductance value of the coil and thereby indicating the open/closed state of the valve. In the circuitry of FIG. 2, the operating/monitor circuit shown therein is capable of detecting a valve closure or partial closure with both low and/or high power applied to the solenoid coil 172 and not just during the normal open/closed cycle as a function of back EMF generated by the solenoid coil as in prior art circuits.

Figure 3A:
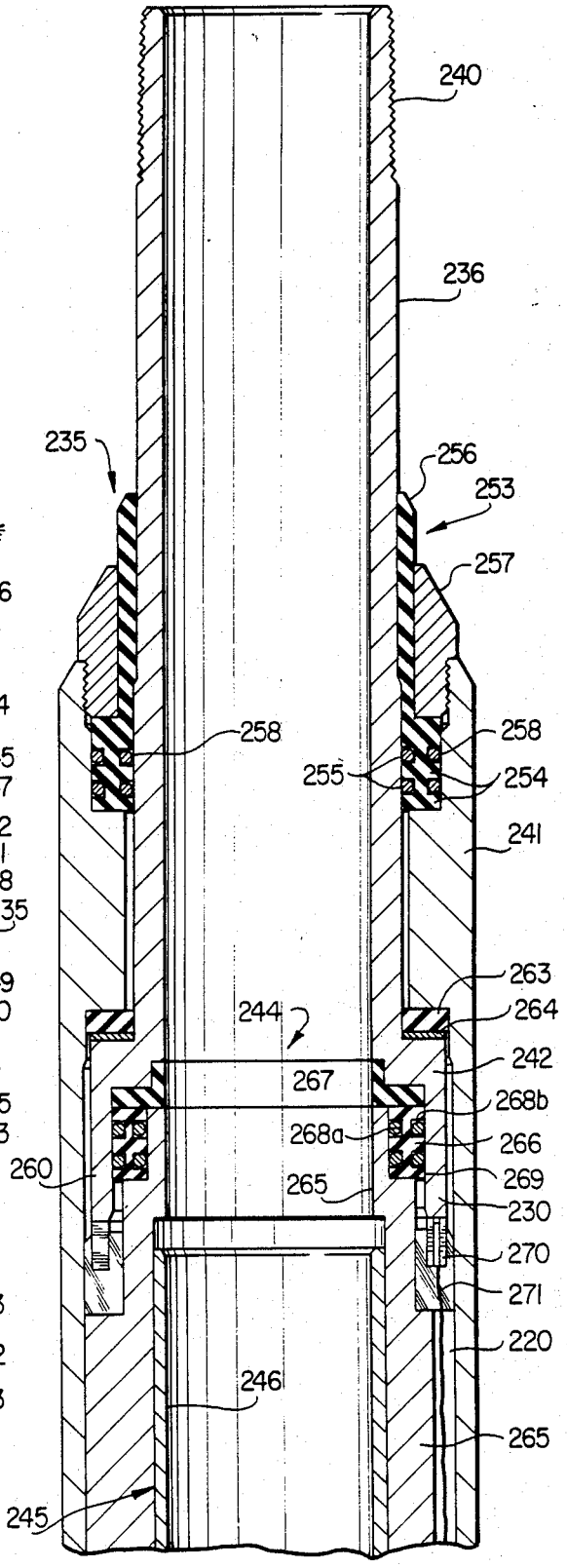
FIGS. 3A–3D are longitudinal cross-section drawings of the solenoid operated safety valve assembly of the system of the present invention.

Referring next to FIGS. 3A–3D, there is shown a longitudinal cross-sectional view through the tubing and solenoid/safety valve assembly showing one embodiment of the manner in which present circuit can be implemented. Referring first to FIG. 3A, the upper end 240 of the assembly support flange 236 is threaded at 240 for coupling to the lower end of a conventional tubing section extending from the surface. The housing 241 of the solenoid actuated safety valve assembly 235 which may be illustratively formed of a conventional relatively less magnetic steel such as 9CR-1MOLY. The assembly support flange 236 is mechanically secured into the upper end of the housing 241 by means of a threaded cylindrical housing seal cap 257. Received between the housing seal cap 257 and the support flange 236 is a cylindrical upper insulating o-ring adapter 253 comprising an upper cylindrical portion 256 and a lower radially outwardly flaring portion 258 of greater diameter and thickness. A pair of external groves 254 and a pair of internal groves 255 receive respective pairs of sealing o-rings on the inside surface abutting the outer wall of the support flange 236 and pairs of sealing o-rings on the outside surface abutting the inside wall of the housing. The lower end of the conductive support flange 236 includes a radially outwardly extending flange portion 242 which flares to a radially increased diameter portion 230 received into a recess 262 within the wall of the housing 241. An upper insulating washer 263 and a spacer 264 separate the upper inside shoulder of the housing 241 from the lower shoulder of the radially flared region 242 of the assembly support flange 236. The upper end of a coil housing insert 265 includes an inwardly stepped region which receives a lower insulating o-ring adaptor 266 which includes a pair of internal groves **268*a* and a pair of external groves 267*b* for receiving, respectively, pairs of o-rings which seal against the inner surface of the wall of the support flange 236 and the outer surface of the housing insert 265. A lower insulating washer 267 serves to space and electrically insulate the upper end of the housing insert 265 from the lower end of the support flange 236. The housing insert 265 and is in direct mechanical and electrical contact with the conductive inner walls of the cylindrical housing 241**.

The lower edge of the conductive support flange 236 includes an electrical connector 270 which is coupled to a single conductor 271 which extends down a vertical groove 220 formed between the inner wall of the housing 241 and the outer wall of the housing insert 265. The conductor 271 extends downwardly and is connected to one end of the solenoid coil 272 mounted in the annular space between the inner well of the housing 241 and the outer wall of the housing insert 265. The other end of the solenoid coil 272 is connected via a single conductor wire 275 into a hole 276 in the lower end of the edge portion of the solenoid coil housing insert 265 and retained with a set screw (not shown). The housing insert 265 is mechanically and electrically connected to the housing 241.

A multi-element cylindrical operator tube 245 includes a relatively thin walled upper segment 246 formed of a relatively less magnetic material such as 9CR-1MOLY steel which also is highly resistant to the highly corrosive borehole fluid environment. The upper segment 246 is threadedly connected to an armature segment 276 which is formed of highly magnetic material such as 1018 low carbon steel alloy which is also highly corrosion resistant. A thin walled, elongate lower segment 248 of the operator tube 245 is threaded to the lower end of the armature segment 276 and formed of the relatively less magnetic material such as 9CR-1MOLY steel. The segment 250 of the operator tube 245 located at the lower end is also of relatively low magnetic material and includes a radially extending edge which abuts a radically extending circular washer 249. The washer overlies and rests on the upper end of a helical spring 251 the lower end of which rests on one of a plurality of stacked cylindrical spacers 281, 282 and 283 which are positioned in a recess in the side wall of the housing 241 against a lower edge thereof 284. The operator tube 245 is adapted for longitudinal movement within the axial passageway 244 formed down the center of the housing 241.

The operator tube 245 is positioned in the passageway 244 of the housing 245 so that the armature segment 276 extends above the upper end of the solenoid coil 272. A tubular magnetic stop member 260 is positioned inside of the housing insert 265 extending below the lower end of the solenoid coil 272. A mechanical stop 290 located at the bottom of the cavity 253 formed in the wall of the housing 241 below the lower end of the operator tube segment 250 limits the extent to which the tube 245 can move in the downward direction. When the operator tube is at its lowest position and abuts the mechanical stop 290 the lower edges **276*a* of the armature segment 276 are spaced by a small but definite air gap from the upper edges 260*a* of the magnetic stop 260. The magnetic stop 260 is formed of a highly magnetic material to form a low reluctance path for magnetic flux generated by the solenoid coil 272 when the armature is in the lower position. This allows the armature 276 to be held adjacent to the magnetic stop 260 by a value of current flow through the solenoid 272 much less than that required to move the operator tube in the downward direction from its upper rest position. The air gap between the lower end edge 276*a* of the armature 276 and the edge 260*a*** of the magnetic stop prevent the pieces from sticking together due to residual magnetism when all current has been removed from the coil 272.

Figure 3D:
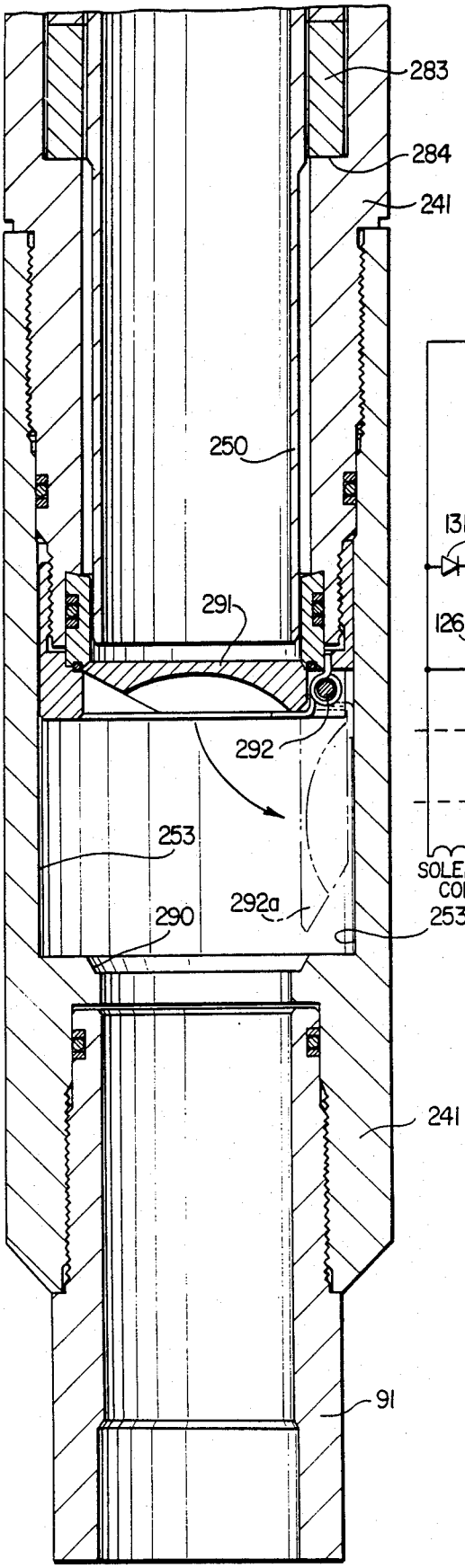

Referring now to FIG. 3D, near the lower end of housing 241 a safety valve flapper 291 is pivotally connected by means of a hinge 292 to the lower end of the housing 241 and pivots about the hinge 292 to the position shown in phantom at **292*a* to open the flow through the valve in response to actuation of the solenoid. The hinge 292 also includes a spring which normally biases the flapper 291 into the closed position as shown. Movement of the tubular member 245 in a downward direction toward mechanical stop 290 causes the flapper 291 to pivot about the hinge 292 into the phantom position 292a and allow fluid flow upwardly into the lower end of the housing 241 and the axial passageway 244** and upwardly through the valve assembly and the tubing toward the surface.

As can be seen from FIG. 3D, when the tubular member 245 moves downwardly in response to magnetic forces produced by current flowing through the windings of the solenoid 272, it presses against the flapper door 291 causing the flapper to move about the hinge 292 into the open position shown in phantom at 292a and allow the flow of production fluids up the tubing leading to the surface. Upon interruption of the current flow through the solenoid coil 272, the helical spring 251 biases the tubular member 245 upwardly allowing the spring biased hinge 292 to move the flapper door 291 toward the closed position.

Current flow through the solenoid 272 comes through the tubing into the support flange 236, the connector 270 and the conductor 271 into one end of the solenoid coil 272. The other end of the coil 272 is connected to conductor 275 and then through connector 276 to the conductive housing insert 265 and to the side walls of the housing 241 which are, of course, insulated from the support flange 236 by means of the insulative upper o-ring adaptor 253 and other insulating elements discussed above.

The electrically conductive housing 241 is connected to the side walls of the well casing by means of slips, as shown in FIG. 1, to complete the electrically conductive path back to the surface via the casing 11. This allows current flow to both initially change the state of the solenoid controlling the valve as well as hold the valve in an open position by means of a lower value of current flow than that necessary to change its state.

Figure 4:
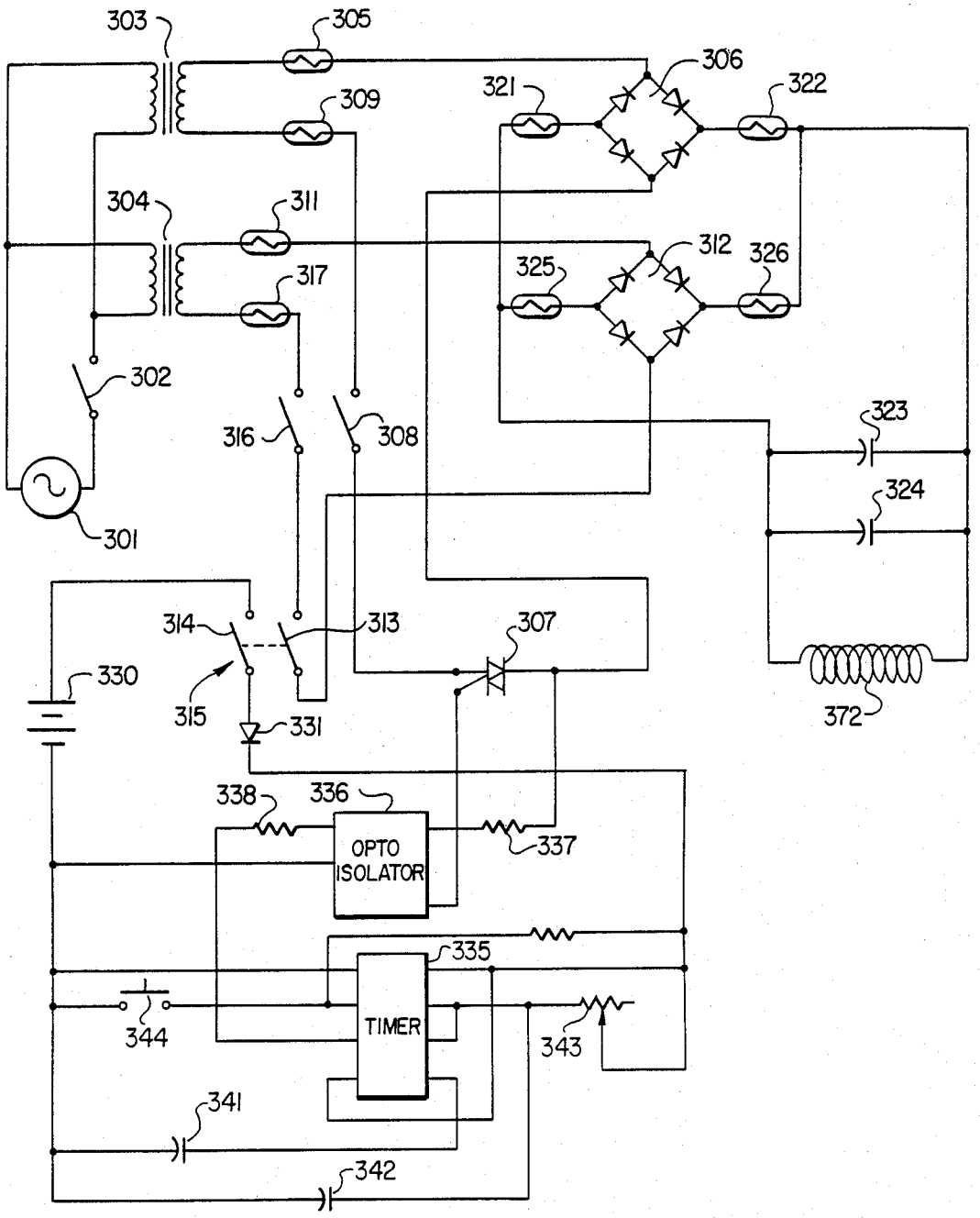
FIG. 4 is an electrical schematic diagram of another embodiment of the electrically operated solenoid actuated safety valve system of the present invention.

Referring now to FIG. 4, there is shown a solenoid switching circuit which may be employed in certain embodiments of the system of the present invention. A 110 volt AC supply 301 is connected through a switch 302 to a pair of parallel connected transformer primaries. A first transformer 303 steps the 110 volt AC signal up to a 220 volt AC value and couples one side of the line through a fuse 305 to an input side of a first full wave bridge diode rectifier 306 the other side of which is connected through a triac switch 307 and a contact switch 308 through a second fuse 309 back to the secondary side of the transformer 303.

The second transformer 304 converts the 110 volt AC input to a 12 volt AC output, one side of which is connected through a third fuse 311 to one side of the input of a second full wave bridge diode bridge 312 the other side of which is connected through one contact 313 of a two contact gang switch 315, through a mechanical switch 316, through a fourth fuse 317 to the secondary side of the transformer 304. The output side of the first bridge 306 is connected through a pair of fuses 321 and 322 across a pair of storage capacitors 323 and 324 which are connected across a solenoid coil 372. The output side of the second connector bridge 312 is similarly connected through a pair of fuses 325 and 326 also across the solenoid coil 372. A DC power source 330 is connected through the contact 314 of the gang switch 315 and a diode 331 to power a timer circuit 335 and an optoisolator 336 connected to trigger the triac 307 through a current limiting resistor 337. The timer circuit 335 includes a timing capacitor 342 and a timing resistor 343. A trigger switch 344 is connected to energize the timer 335 into operation. The timer 335 is coupled to the optoisolator 336 by means of a coupling resistor 338. The optoisolator may take the form of a Motorola MOC3010 optoisolator circuit while the timer may comprise a TLC555 timer circuit.

In the operation of the circuitry of FIG. 4, the switch 301 is closed to apply power to the primary side of the transformers 303 and 304 and thence to the rectification bridges 306 and 312 through the fuses 305, 309, 311 and 317 as well as the switches 316, 308 and 313. Switches 308 and 316 are closed to place the gang switch 315 and the triac 307 in the circuit. At this point, still no power has been applied to the solenoid coil 372.

Closing switch 315 applies a low DC to solenoid coil 372 from the rectifier bridge 312 due to energization of the transformer 304. Closing the switch 315 also energizes the optoisolator 336 and timer 335 switching the triac 307 to apply a high voltage DC current to the solenoid coil 372 through the rectifier bridge 306 energized by the transformer 303.

After a preset time established by the values set by means of resistor 343 and capacitors 341 and 342, the timer 335 through the optoisolator 336 turns off the triac 307 interrupting the high voltage DC to the solenoid coil 372 leaving only the low voltage DC from the rectifier 312 to hold the solenoid actuated following initial energization.

Momentary contact with the push button switch 344 recycles the timer 335 to agin trigger the triac 307 through the optoisolator 336 and apply high voltage from the rectifier 306 to the solenoid coil 372.

Opening the switch 315 disconnects the low voltage hold open voltage from the rectifier 312 interrupting all current flow to the solenoid coil 372 allowing the valve to close.

Both of the bridge rectifiers 306 and 312 allow the passage of reverse current created by the back EMF generated by the collapse of the field in the coil 372 and prevent any damage due to back EMF.

As can be seen from the operation of the structure and circuitry described above, the system of the present invention allows current to flow down the electrically conductive regions of the tubing and casing of a conventional well completion into a electrically operated solenoid actuated safety valve assembly and enable actuation of the valve without the provision of external electrical cables to the system. The system of the present invention provides an enhanced mode of operation without the provision of additional cabling and installation expense.

It should also be noted that the electrically operated solenoid actuated safety valve also allows the monitoring of the condition of the safety valve on a continuous basis rather than only intermittently in response to the generation of back EMF during the switching and changing of the state of the valve from one to another. The system thereby allows monitoring and control over the safety valve system of the present invention on a substantially enhanced basis and allows much more flexibility than the systems of the prior art.

Thus can be seen how the system of the present invention overcomes the difficulties inherent in the prior art systems by providing power and monitoring signals along the casing of the well completion itself. This eliminates the necessity for any additional cabling down in the borehole in order to supply both the operating power needs of the electrically operated solenoid actuated safety valve and at the same time to continuously monitor the condition of the valve.

It is thus believed that the operation and construction of the present invention will be apparent from the foregoing description. While the method, apparatus and system shown and described has been characterized as being preferred it would obvious that various changes and modifications may be made therein without departing from the spirit and the scope of the invention as defined in the following claims.

What is claimed is:

1. An electrically operated solenoid actuated valve system for use in a borehole, comprising:

a well casing formed of electrically conductive material extending down the walls of the borehole;

a production tubing extending co-axially down the casing for the flow of borehole fluids from within the well to the wellhead, said tubing being formed of electrically conductive material and mechanically supported at the wellhead but being electrically insulated from the casing;

a tubular safety valve housing assembly attached to the tubing by means of a mounting assembly mechanically connected to the lower end of the tubing but being electrically insulated therefrom, said housing having means for mounting therein a solenoid coil and an armature moveable therein being affixed to actuate a safety valve in response to the flow of current through the solenoid coil, said safety valve being closed by a spring bias in response to deenergization of said coil, the body of said housing being electrically connected to the casing of said well bore to complete an electrical circuit therewith;

means for applying an electric current potential between the casing and tubing at the well head to cause current flow through the coil of said solenoid within said housing and produce movement of the armature of said solenoid to effect opening of said safety valve in response thereto.

2. An electrically operated solenoid actuated valve system for use in a borehole, comprising:

a well casing formed of electrically conductive material extending down the walls of the borehole;

a production tubing extending co-axially down the casing for the flow of borehole fluids from within the well to the wellhead, said tubing being formed of electrically conductive material and mechanically supported at the wellhead but being electrically insulated from the casing;

a tubular safety valve housing assembly attached to the tubing by means of a mounting assembly mechanically connected to the lower end of the tubing but being electrically insulated therefrom, said housing having means for mounting therein a solenoid coil and an armature moveable therein being affixed to actuate a safety valve in response to the flow of current through the solenoid coil, said safety valve being closed by a spring bias in response to deenergization of said coil, the body of said housing being electrically connected to the casing of said well bore to complete an electrical circuit therewith;

means for applying an electric current potential between the casing and tubing at the well head to cause current flow through the coil of said solenoid within said housing and produce movement of the armature of said solenoid to effect opening of said safety valve in response thereto;

a tubing flange connected to the wellhead for supporting the tubing extending down the borehole but electrically insulating the tubing from the support structure at the wellhead; and means for mechanically connecting but electrically isolating the housing of the safety valve from the lower end of the tubing.

3. A solenoid operated valve system as set forth in claim 2 wherein said means for isolating said housing from said tubing includes an upper insulating adaptor having a cylindrical portion extending between the side walls of the tubing support adaptor and the inner end of the housing, said adaptor including a radial extending flared region having a plurality of circumferential grooves for the receipt of o-ring seals fitted therein to mechanically seal the interior of the housing against the impingement of borehole fluids.

4. A solenoid operated valve system as set forth in claim 2 which also includes a set of mechanical slips located at the lower end of said housing and having a set of toothed dog members for engaging the inside wall of the casing to provide a mechanical support for the housing as well as electrical contact between the casing and the housing to allow current flow to operate the solenoid.

5. The solenoid operated valve system as set forth in claim 4 which also includes a means for applying a first higher value of current to the solenoid coil in order to effect operation of the solenoid and a second lower value of current to the solenoid coil to hold it in operation once actuation has been effected.

6. A solenoid operated valve system as set forth in claim 5 wherein said safety valve housing assembly also includes a magnetic stop located near the lower end of the armature when in its lower position to allow holding of the armature in the lower position when a lower value of current is applied through the armature.

7. A control system for applying power to a solenoid operated valve in a well completion within a borehole comprising:

means mounted within a surface control unit for selectively applying electric power at a first higher value and a second lower value to the tubing and casing of said well completion;

means for electrically insulating the tubing and casing of said well completion from one another;

means located in said tubing and responsive to said higher power current for changing the state of said solenoid and responsive to the lower value of said current for maintaining the state of said safety valve and responsive to interruption of all current for closing said safety valve;

means mounted within said surface monitoring and control unit for continuously monitoring the state of actuation of said safety valve and providing an indication at the well surface.

8. A control system as set forth in claim 7 wherein said system includes means mounted within said surface control unit for rectifying AC power and producing DC current at two different selected current values.

9. A method of supplying power to a solenoid operated valve in a downhole well completion comprising:

electrically insulating the tubing and casing of said well completions from one another;

providing a solenoid operated valve in said tubing having one end of the solenoid connected to said tubing and the other end of the solenoid connected to the casing; and selectively supplying electric power at a pair of current values, a first higher value being applied between said tubing and casing to cause switching of the solenoid from a first state to a second state thereby opening the valve, and a second lower value being applied between said tubing and casing to hold said valve in an operated condition once switching has occurred.

10. An electric solenoid actuated valve system for use in well completions of the type which includes an electrically conductive well casing extending down the borehole and electrically conductive tubing extending coaxially within the casing for the flow of fluids from within the borehole to a well head located at the surface, said system comprising:

means for mechanically supporting said tubing by the wellhead and electrically insulating said tubing therefrom;

a normally closed electric solenoid actuated safety valve positioned within said borehole and connected to the lower end of said tubing to control the flow of fluids from within the borehole to the wellhead, the electric solenoid having an energization coil with first and second ends and an armature being connected to said valve to open said valve when an electric current flows through the coil to produce movement of the armature;

means for electrically insulating the tubing from the casing from a point above said mechanical support means to a point below said safety valve;

means for electrically connecting the first end of said solenoid energization coil to said tubing and the second end thereof to said casing; and means for applying one polarity of electric current to said tubing at a point below said mechanical support means at the wellhead and applying the other polarity of electric current to said casing at the wellhead to energize said solenoid coil and produce movement of the armature to open said safety valve and permit the flow of fluids to the wellhead.

11. An electric solenoid acuated valve system as set forth in claim 10 wherein said solenoid actuated safety valve includes:

an elongated conductive housing having a central passageway therethrough;

means for mechanically connecting and electrically insulating the upper end of said housing to the lower end of the tubing for fluid communication between the tubing and the passageway;

a normally closed valve flapper mounted to the lower end of said elongate housing and extending across the lower end of the passageway to prevent the flow of fluids from within the borehole into the passageway;

a solenoid energization coil mounted within a cavity in the sidewalls of said elongate housing and surrounding the passageway;

an elongate operator tube formed of magnetic material coaxially mounted for limited longitudinal movement in the downward direction within the passageway through said housing in repsonse to magnetic forces produced by said solenoid coil, said operator tube having an longitudinal opening to permit the flow of fluids therethrough and having the lower end thereof positioned adjacent the normally closed valve flapper to open said valve upon downward movement of said operator tube;

means for electrically connecting the first end of said solenoid energization coil to the lower end of said tubing and the second end of said coil to said conducive housing; and means for electrically connecting said housing to the sidewalls of said casing to complete the electrical circuit for energizing said solenoid coil to said valve.

12. An electric solenoid actuated valve system for use in well completions of the type which includes an electrically conductive well casing extending down the borehole and electrically conductive tubing extending coaxially within the casing for the flow of fluids from within the borehole to a well head located at the surface, said system comprising:

means for mechanically supporting said tubing by the wellhead and electrically insulating said tubing therefrom;

a normally closed electric solenoid actuated safety valve positioned within said borehole and connected to the lower end of said tubing to control the flow of fluids from within the borehole to the wellhead, the electric solenoid having an energization coil with first and second ends and an armature being connected to said valve to open said valve when an electric current flows through the coil to produce movement of the armature;

means for electrically insulating the tubing from the casing from a point above said mechanical support means to a point below said safety valve;

means for electrically connecting the first end of said solenoid energization coil to said tubing and the second end thereof to said casing;

means for applyinng one polarity of electric current to said tubing at a point below said mechanical support means at the wellhead and applying the other polarity of electric current to said casing at the wellhead to energize said solenoid coil and produce movement of the armature to open said safety valve and permit the flow of fluids to the wellhead; wherein said solenoid actuated safety valve includes:

an elongated conductive housing having a central passageway therethrough;

means for mechanically connecting and electrically insulating the upper end of said housing to the lower end of the tubing for fluid communication between the tubing and the passageway;

a normally closed valve flapper mounted to the lower end of said elongate housing and extending across the lower end of the passageway to prevent the flow of fluids from within the borehole into the passageway;

a solenoid energization coil mounted within a cavity in the sidewalls of said elongate housing and surrounding the passageway;

an elongate operator tube formed of magnetic material coaxially mounted for limited longitudinal movement in the downward direction within the passageway through said housing in response to magnetic forces produced by said solenoid coil, said operator tube having an longitudinal opening to permit the flow of fluids therethrough and having the lower end thereof positioned adjacent the normally closed valve flapper to open said valve upon downward movement of said operator tube;

means for electrically connecting the first end of said solenoid energization coil to the lower end of said tubing and the second end of said coil to said conducive housing;

means for electrically connecting said housing to the sidewalls of said casing to complete the electrical circuit for energizing said solenoid coil to said valve; and wherein said operator tube comprises:

an upper cylindrical tube section having relatively thin walls and being formed of relatively less magnetic material in comparison to highly magnetic material;

a lower cylindrical tube section having relatively thin walls and being formed of relatively less magnetic material in comparison to highly magnetic material; and a central cylindrical tubular armature system coaxially connected between said upper and said lower sections and being formed of highly magnetic materials, said armature being located near the upper end of said solenoid coil for downward movement in response to current flow through said solenoid.

13. An electric solenoid actuated valve system as set forth in claim 12 wherein:

said operator tube is spring biased toward its upper positions.

14. An electric solenoid actuated safety system as set forth in claim 13 which also includes:

a cylindrical magnetic stop formed of highly magnetic material mounted within the passageway of said housing adjacent the lower end of said solenoid coil surrounding the lower cylindrical section of said operator tube and having upper edges being spaced by an air gap from the lower edges of the armature section of the operator tube when said tube is located in its lower position in response to current flow through said coil, said magnetic stop serving to increase the flow of magnetic flux and retain said operator tube in its lower position in response to a lower value of electric current flow through the coil than the current flow required to initially move the tube from its upper to its lower position against its spring bias.

15. An electric solenoid actuated valve system for use in well completions of the type which includes an electrically conductive well casing extending down the borehole and electrically conductive tubing extending coaxially within the casing for the flow of fluids from within the borehole to a well head located at the surface, said system comprising:

means for mechanically supporting said tubing by the wellhead and electrically insulating said tubing therefrom;

a normally closed electric solenoid actuated safety valve positioned within said borehole and connected to the lower end of said tubing to control the flow of fluids from within the borehole to the wellhead, the electric solenoid having an energization coil with first and second ends and an armature being connected to said valve to open said valve when an electric current flows through the coil to produce movement of the armature;

means for electrically insulating the tubing from the casing from a point above said mechanical support means to a point below said safety valve;

means for electrically connecting the first end of said solenoid energization coil to said tubing and the second end thereof to said casing; and means for applying one polarity of electric current to said tubing at a point below said mechanical support means at the wellhead and applying the other polarity of electric current to said casing at the wellhead to energize said solenoid coil and produce movement of the armature to open said safety valve and permit the flow of fluids to the wellhead;

wherein said means for electrically connecting said solenoid energization coil to said casing includes a set of slips for engaging the sidewalls of the casing.

16. An electric solenoid actuated valve system for use in well completions of the type which includes an electrically conductive well casing extending down the borehole and electrically conductive tubing extending coaxially within the casing for the flow of fluids from within the borehole to a well head located at the surface, said system comprising:

means for mechanically supporting said tubing by the wellhead and electrically insulating said tubing therefrom;

a normally closed electric solenoid actuated safety valve positioned within said borehole and connected to the lower end of said tubing to control the flow of fluids from within the borehole to the wellhead, the electric solenoid having an energization coil with first and second ends and an armature being connected to said valve to open said valve when an electric current flows through the coil to produce movement of the armature;

means for electrically insulating the tubing from the casing from a point above said mechanical support means to a point below said safety valve;

means for electrically connecting the first end of said solenoid energization coil to said tubing and the second end thereof to said casing; and means for applying one polarity of electric current to said tubing at a point below said mechanical support means at the wellhead and applying the other polarity of electric current to said casing at the wellhead to energize said solenoid coil and produce movement of the armature to open said safety valve and permit the flow of fluids to the wellhead;

wherein said means for electrically connecting said housing to said casing includes a tubing centralizer having bow spring means engaging said casing.

17. An electric solenoid actuated valve system as set forth in claim 10 within said means for electrically insulating the tubing from the casing comprises:

a relatively non-conductive fluid in the annular space between the tubing and casing.

18. An electric solenoid actuated valve system as set forth in claim 17 wherein the fluid is any one of kerosene, oil base mud, or an oil external emulsion completion fluid.

19. A well completion valve system for use in production tubing disposed within casing for controlling production flow, said system comprising:

a wellhead support coupling adapted for mechanically securing a depending portion of said tubing within said casing and electrically insulating said tubing therefrom;

a normally closed solenoid actuated safety valve secured in said tubing in flow communication therewith and actuatable by electric current for production flow therethrough;

a valve support coupling adapted for mechanically securing an upper section of said safety valve and electrically insulating said tubing therefrom;

a first conductor electrically connecting a first terminal of said solenoid to said tubing;

a second conductor electrically connecting a second terminal of said solenoid to said casing;

means for producing an electric current;

a first coupling means electrically connecting said current producing means to said tubing disposed beneath said support coupling; and a second coupling means electrically connecting said current producing means to said casing for completing a current flow path from said current producing means through said solenoid for actuating said solenoid and opening said safety valve.

20. A safety system as set forth in claim 19 wherein said wellhead support coupling further comprises:

a tubing head secured atop said depending portion of said tubing;

a tubing flange connected to said production tubing extending above the depending portion of said tubing;

a recess formed within said tubing head with said tubing flange being received therein; and an electrical insulator disposed between said tubing head and said tubing flange for mechanically connecting and electrically isolating said depending portion of said tubing from said production tubing thereabove.

21. A valve system as set forth in claim 10 and further including a tubing head insulator extending axially of and circumferentially about said tubing head for insulating said tubing head from said casing.

22. A valve system as set forth in claim 19 wherein said normally closed solenoid actuated safety valve comprises an electric energization coil with first and second ends, said first end being connected to said first conductor and said second end being conducted to said second conductor.

23. A valve system as set forth in claim 22 and further including:

a tubular housing having a central passage formed therethrough, said energization coil being constructed around said central passage in generally concentric alignment therewith; and an operator tube mounted therein and adapted for axial movement in response to current flow through said energization coil.

24. A valve system as set forth in claim 23 wherein said operator tube is constructed with an armature formed therearound and disposed in generally concentric alignment within said energization coil for axial movement in response to the current flow therethrough.

25. The valve system as set forth in claim 24 and further including:

said operator tube being constructed with a collar region extending radially outwardly in a lower portion thereof;

said valve housing being formed with a central recess having a diameter larger than said central passage and disposed opposite said radical extending collar region of said operator tube for facilitating axial travel therewithin; and a spring disposed within said housing recess for engaging said operator tube collar and biasing said operator tube upwardly for closing said safety valve.

26. The valve system as set forth in claim 25 wherein said safety valve comprises a flapper disposed beneath said operator tube and constructed for closing said flow passage therethrough in response to upward movement of said operator tube.

27. A valve system as set forth in clai, 19 wherein said safety valve includes a generally cylindrical housing having an upper insulative adapter constructed for mechanical connection with electrical insulation from said tube.

28. A valve system as set forth in claim 27 wherein said first conductor comprises a conductive element extending through said upper insulative adapter of said housing into electrical contact with said tube.

29. A valve system as set forth in claim 19 wherein said second conductor which electrically connects the second portion of said solenoid to said casing comprises a plurality of casing engagement elements radially extending from said valve into electrical contact with said casing.

30. A control system for applying power to a solenoid operated valve in a well completion within a borehole comprising:

means mounted within a surface control unit for selectively applying electric power to the tubing and casing of said well completion;

means for electrically insulating the tubingj and casing of said well completion from one another;

means located in said tubing and responsive to said electric power for changing the state of said solenoid and opening said safety valve and interruption of electric power for closing said safety valve;

means mounted within said surface monitoring and control unit for continuously monitoring the state of actuation of said safety valve and providing an indication at the well surface.

31. A control system as set forth in claim 30 wherein said electric power consists of DC current.

32. A control system as set forth in claim 31 wherein the polority of said DC current is periodically reused for enhanced protection against cathodic corrosion within said system.

33. A control system as set forth in claim 32 wherein said solenoid operated valve is a safety valve.

34. A control system as set forth in claim 30 wherein said solenoid operated valve is a gas lift valve.

35. An electric solenoid actuated valve system for use in a well completion of the type which includes an electrically conductive well casing extending down the borehole and electrically conductive tubing extending coaxially within the casing for the flow of fluids from within the borehole to a well head located at the surface, said completion also including means for insulating the tubing at the casing from a point above the mechanical support for the tubing, and means for applying electric current to the tubing at a point below the mechanical support means thereof and also to the casing at the wellhead, said system comprising:

means for mechanically supporting said tubing by the wellhead and electrically insulating said tubing therefrom;

a normally closed electric solenoid actuated safety valve positioned within said borehole and connected to the lower end of said tubing to control the flow of fluids from within the borehole to the wellhead, the electric solenoid having an energization coil with first and second ends, and being connected to said valve to open said valve when an electric current flows through the coil; and means for electrically connecting the first end of said solenoid energization coil to said tubing and the second end thereof to said casing.

36. An electric solenoid actuated well valve operable by current flow through well tubing and well casing in a well bore for controlling well fluid flow into a tubing string in a well bore comprising:

an elongated conductive housing having a central passageway therethrough;

means for mechanically connecting and electrically insulating the upper end of said housing to the lower end of a tubing string in a well bore for fluid communication between the passageway of the housing and the tubing string;

a normally closed valve member mounted in the lower end of said housing and movable between open and closed positions across the lower end of said passageway in said housing to control flow of well fluids into said passageway;

a solenoid energization coil mounted within a cavity in the sidewalls of said housing and surrounding said passageway;

an elongate operator tube formed of magnetic material coaxially mounted for limited longitudinal movement within said passageway in said housing in response to magnetic forces produced by said solenoid coil, said operator tube having a longitudinal opening therethrough to permit flow of fluids and having the lower end thereof positioned to engage and open said normally closed valve, to open said valve member upon downward movement of said operator tube;

means for electrically connecting a first end of said solenoid coil to the lower end of a tubing string when said valve is supported on a tubing string in a wellbore;

means for electrically connecting the second end of said coil to said housing; and means for electricaly connecting said housing to a well bore casing.

37. An electric solenoid actuated valve in accordance with claim 36 wherein said operator tube comprises:

an upper cylindrical tube section having relatively thin walls and formed of relatively less magnetic material in comparison to highly magnetic material; a lower cylindrical tube section having relatively thin walls and being formed of relatively less magnetic material in comparison to highly magnetic material; and a central cylindrical tubular armature section coaxially connected between said upper and lower sections and being formed of highly magnetic material, said armature section being located near the upper end of said solenoid coil for downward movement in response to current flow through said coil.

38. An electric solenoid actuated valve in accordance with claim 37 including spring means coupled with said operator tube biasing said operator tube upwardly toward a valve-closed position.

39. An electric solenoid valve in accordance with claim 38 including a cylindrical magnetic stop formed of highly magnetic material secured with said housing and positioned within the passageway of said housing within the lower end portion of said solenoid coil surrounding said operator tube and having an upper end edge spaced by an air gap from the lower end edge of said armature section of said operator tube when said operator tube is at a lower valve-open position responsive to current flow through said coil, said magnetic stop restraining said operator tube at said lower valve-open position responsive to a lower value of current through said coil than required to initially move said operator tube from an upper valve-closed position to said lower valve-open position against said spring.

40. An electric solenoid actuated valve in accordance with claim 39 wherein said means for connecting and insulating said housing with said tubing comprises, a tubular coupling member having a threaded upper end portion and an externally flanged lower end portion fitting in an annular recess in an upper end portion of said housing; an annular insulating seal between said tubular member and said housing insulating said tubular member electrically from said housing; an electrical conductor from a lower end of said tubular member to said first end of said coil; and an electrical conductor from said second end of said coil to said housing.

41. An electric solenoid actuated valve in accordance with claim 40 wherein said valve member is a flapper type valve hinged to said housing for movement between a first closed position across flow passage through said housing below the lower end of said operator tube when said operator tube is at an upper end position and a second open position wherein said flapper valve is pivoted downwardly by said operator tube to permit fluid flow into said passageway through said operator tube.

42. An electric solenoid actuated valve in accordance with claim 41 wherein said operator tube is concentrically spaced within said housing defining an annular cavity between said operator tube and said housing and said spring around said operator tube is compressed between an upper stop flange on said operator tube and a lower stop shoulder supported within said housing.

43. An electric solenoid actuated valve in accordance with claim 36 wherein said solenoid coil is operable by AC current.

44. An electric solenoid actuated valve in accordance with claim 36 wherein said solenoid coil is operable by DC current.

* * * * *